United States Patent [19]

Rado

[11] 4,353,465

[45] Oct. 12, 1982

[54] PORTABLE TRAY FOR MECHANICS SOCKETS

[76] Inventor: Robert J. Rado, 5330 W. Fletcher, Chicago, Ill. 60641

[21] Appl. No.: 272,510

[22] Filed: Jun. 11, 1981

[51] Int. Cl.[3] ..... B65D 85/20; B65D 1/34

[52] U.S. Cl. ..... 206/378; 206/493; 206/565; 211/60 T; 312/DIG. 33

[58] Field of Search ..... 206/378, 493, 303, 392, 206/310, 565, 566; 211/60 T, 59.1; 217/23, 24; 312/DIG. 33; 223/106, 107

[56] References Cited

U.S. PATENT DOCUMENTS

| | | | |
|---|---|---|---|
| 380,174 | 3/1888 | Bowles | 206/391 |
| 777,823 | 12/1904 | Webster et al. | 206/566 X |
| 1,712,473 | 5/1929 | McWethy | 206/378 |
| 1,943,543 | 1/1934 | McDonough | 312/DIG. 33 X |
| 3,405,377 | 10/1968 | Pierce | 206/378 X |
| 3,532,221 | 10/1970 | Kaluhiokalani et al. | 211/60 T |
| 3,726,393 | 4/1973 | Thompson | 206/378 |

FOREIGN PATENT DOCUMENTS

| | | | |
|---|---|---|---|
| 949040 | 9/1956 | Fed. Rep. of Germany | 206/378 |

*Primary Examiner*—William T. Dixson, Jr.
*Assistant Examiner*—Brenda J. Ehrhardt
*Attorney, Agent, or Firm*—James J. Conlon

[57] ABSTRACT

A tray for storing and retaining sockets such as those used by machanics has handles and a top surface with openings providing a plurality of seats with a base portion depressed below the top. Resilient, spring-like socket retainers are located in each seat. The resilient retainers have outwardly extending legs which contact a portion of the depressed base portion of the seat and rest thereon. As sockets are placed over the resilient retainer, the retainer is slightly urged together providing a spring force which grips the socket securely, holds it in place and prevents it from being removed unintentionally.

7 Claims, 8 Drawing Figures

FIG. 5
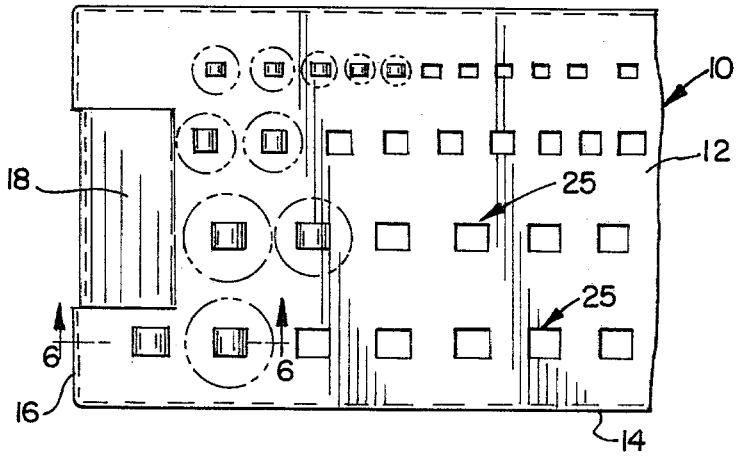
FIG. 7
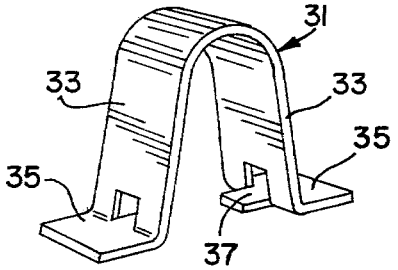
FIG. 4
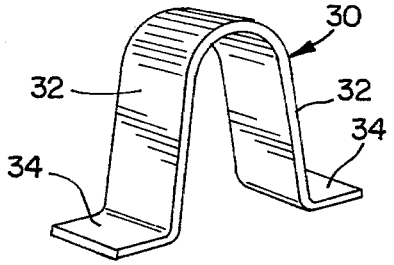
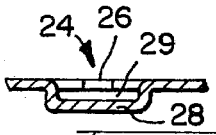
FIG. 8
FIG. 6
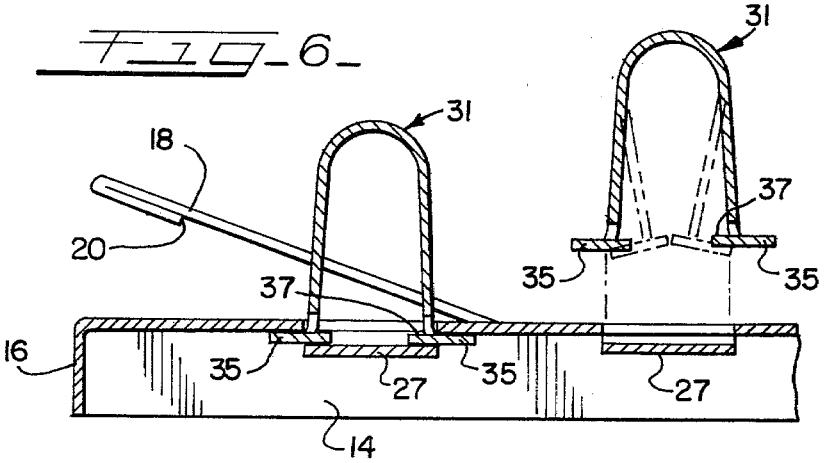

PORTABLE TRAY FOR MECHANICS SOCKETS

BACKGROUND OF THE INVENTION (1) Field of the Invention

This disclosure pertains to a portable tray used by automobile mechanics and the like to store sockets. More specifically, the tray provides a number of upstanding resilient spring members which not only store and locate the sockets located thereon but also provide a spring force which grips the internal section of each socket to hold it securely in place.

(2) Description of the Prior Art

While the prior art has primarily been cluttered with homemade devices such as trays having dowel rods or round openings, drill rods extending from metal plates and the like, there have been few formal attempts to provide a product which is commercially feasible and commercially accepted. One such device which is currently available is merely a flat tray having circular openings extending therethrough. When the tray is lifted the sockets fall through because there is no structure provided for gripping or retaining the sockets to prevent the sockets from being dislodged or vibrated loose should the tray be inadvertently dropped or turned over or the like. While it has long been desirable to provide a device for neatly and securely storing mechanic's sockets in such a fashion that the sockets can be easily organized and viewed for selection purposes, there has been no product offered which has met all these requirements.

The socket tray shown in this disclosure fulfills the requirements. A tray is provided and is highly portable and has resilient gripping fingers which easily accept various size sockets, store the sockets neatly and provide a gripping force to hold the sockets in position so that they will not inadvertently become dislodged from the stored position.

SUMMARY

This disclosure pertains to a portable storage tray or rack for sockets. The tray provides a pair of handles which are easily grasped and remain functional because of an over-turned flange which provides a raised surface in such a fashion which is easily grasped even though a mechanic's hands may be oily or greasy. Thus, the tray will not slip from his or her hands during transport. The storage product disclosed herein also provides a number of rows of openings having resilient socket engaging fingers which adapt the tray to provide a means for storing a full range of sockets including ½ inch, ⅜ inch, ¼ inch and a set of metric sockets.

Structurally, the tray includes a raised top surface, sides and ends extending around the periphery. Handles are formed at each end by shearing and bending upwardly a portion of the tray top. A number of depressions are formed in the top surface of the tray by merely indenting the tray and depressing a portion thereof. By depressing these so-called seats in the top of the tray very thin slits are provided transversely spaced about the depression at each side of the so-called seat. Resilient retainer springs or fingers having outwardly extending legs may then be inserted in the slits and securely held in position. While the sides of the fingers abut the opening, the legs are allowed to move freely back and forth through the slit and come together as a socket is inserted on an associated finger. As the sides are urged together, they provide a spring force which holds the socket securely in place. Since the sides of the fingers are urged together only a short distance, the legs are not removed from their slits and the finger will remain in place even as the socket is removed.

There are two versions shown, the first version shows a series of openings formed in the top of the tray and providing a generally square opening having smaller slots spaced across the opening. Metal removed from the top surface of the tray is depressed below the top surface and forms a ledge which has the same form as a cutout. The depressed portion or ledge also provides a pair of extensions which form a supporting member for resilient fingers which are inserted into each seat. A modified form of the invention provides rectangular cutouts. The associated springs have tabs integrally formed therein which extend in an opposite direction from the outwardly extending legs which fit in slits formed between the top surface of the tray and the depressed seat. The tabs rest on the edge of the depressed base and prevent the fingers from being pushed through the tray when sockets are inserted.

It is thus an object of this disclosure to provide a portable tray member having resilient fingers secured in seats on the surface of the tray, the seats being integrally formed with the top.

It is yet another object of this disclosure to provide a tray for storing sockets used by mechanics and including resilient fingers extending upwardly from a top of the tray wherein the supporting fingers rest on a depressed base portion which is integrally formed from the top of the tray surface.

These and other objects of the disclosure will become apparent to those having ordinary skill in the art with reference to the following description, drawings and appended claims.

BRIEF DESCRIPTION OF THE DRAWINGS

FIG. 4 is a pictorial illustration of one form of spring used with the openings shown in FIG. 1;

FIG. 5 is a top plan view with portions removed of a modified form of the invention showing rectangular openings formed in the top of the tray;

FIG. 6 is a sectional view taken generally along lines 6—6 of FIG. 5;

FIG. 7 is a pictorial view of a modified form of the resilient fingers as is used with the tray design shown in FIG. 5; and FIG. 8 is a transverse sectional view of a typical opening of the tray shown in FIG. 1.

DESCRIPTION OF THE PREFERRED EMBODIMENT

Figure 1:
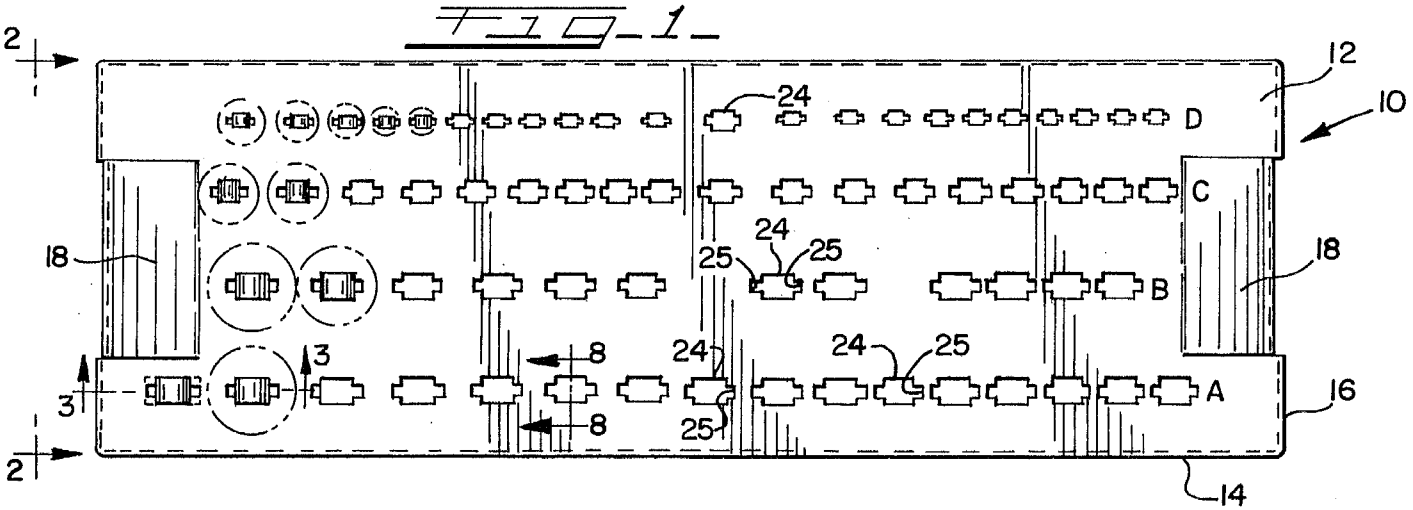
FIG. 1 is a top plan view of the tray showing one form of opening formed in the top surface.

Referring now to the drawings and in particular to FIG. 1, there is shown the tray member which is designated generally by the numeral 10. Tray 10 includes a flat top and pairs of spaced downwardly extending sides 14 and ends 16. While it is shown that the tray is a metal piece having formed sides and ends, it is also contemplated that rubber legs or other types of structural members could be used to provide support for the tray. Similarly, the tray could be molded of plastic. The tray also includes an integrally formed, upwardly extending handle member 18 which has folded over edges 20 which provide a ridge which allow the tray to be easily grasped. For example, if a mechanic wishes to transport the tray from one location to another, the edge 20 is grasped and, regardless of whether the mechanic's fingers are oily or greasy, the step or edge 20 insures that the tray can be easily grasped and will not slip from the mechanic's grip.

Figure 3:
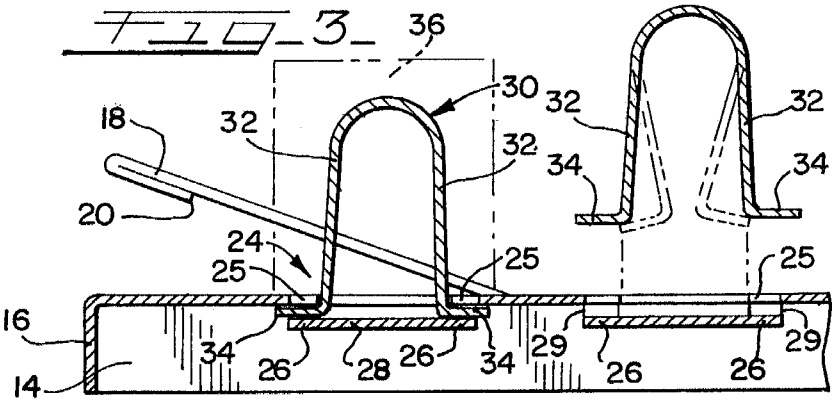
FIG. 3 is a sectional view taken generally along lines 3—3 of FIG. 1.
Figure 2:
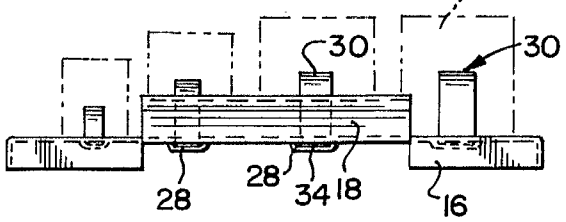
FIG. 2 is a view taken generally along lines 2—2 of FIG. 1.

The top 12 has a number of integrally formed seats designated generally as 24. As shown in FIG. 1, the seat 24 includes a generally rectangular opening having spaced slot sections 25. The outline of the openings formed in the top is that of a square cutout with arms 25 extending therefrom. Thus as the seats are punched in the top 12, metal cutout from the main section 24 and slots 25 will be punched out of the top and deformed below the top 12 and provide extensions 26 to the main body of the cutout or the base 28 (FIG. 3). The base 28 is in effect a depressed section of the top 12 and is spaced downwardly from the underside of the top 12 a short distance to provide a slit 29 (FIG. 8).

Each seat formed in the top of the tray 10 provides a means for accepting a resilient finger 30 to securely hold a socket in position. The type of finger associated with the cutout geometry shown in the tray of FIG. 1 is shown in FIG. 4 and designated by the numeral 30. The retainer or finger 30 has a pair of spaced sides extending downwardly from a rounded or otherwise configured top. A pair of horizontally extending legs 34 extend outwardly from the side 32. The thickness of the finger 30 is designed to provide a spring force which when the finger is inserted into the top of the seat of the tray 10, a spring force is provided to securely hold sockets. Also, the thickness must correspond with the depth of the opening of each slot 29 to allow the legs 35 to be easily extended through each slit 29. As shown in FIG. 3, the finger 30 is momentarily compressed in order that the legs 34 contact one another and allow clearance so that the legs can fit into seat 24 and the legs 34 can be inserted through the slits 29.

Another form of the tray and retaining finger arrangement is shown in FIGS. 5–7. FIG. 5 shows a tray 10 having a top 12 in which rectangular cutouts are formed providing a simple depressed base 27 (FIG. 6). In this type of simple tray, where a rectangular cutout and deformed piece is provided, a spring member or finger 31 such as that shown in FIG. 7 should be utilized. Finger member 31 has spaced sides 33 terminating with outwardly extending legs 35. The legs 35 in this simple arrangement are somewhat modified in that they are also provided with inwardly extending tab members 37. As shown in FIG. 6, when the spring 31 is inserted into the tray 10, the tabs 37 rest upon the base 27 and prevent the finger 31 from being pushed through the tray member when a vertical force is applied such as which occur when a socket is inserted atop the finger 31.

Each finger 30,31 is constructed of spring steel. As shown in FIG. 1, the tray 10 has four rows of openings A, B, C, D adapted to receive fingers for holding various size sockets the bottom rows A, B has fingers for holding one half inch (½ inch) sockets. Associated fingers for holding the one half inch sockets are made from spring steel 0.020 inches thick, approximately 15/32 inches wide and one inch high. The spring fingers for holding three-eights inch sockets are located in row C and are 0.015 inches thick 11/32 inches wide and three fourths of an inch in height. Lastly, the spring fingers for one quarter inch sockets are located in row D, are about one half inch in height and 0.010 thick and 7132 inches in width. With these dimensions, sockets may be easily fitted onto the fingers and securely held in place.

The rows A, B, C, D are spaced apart in such a fashion that when the tray is loaded with sockets, the weight is evenly balanced about the longitudinal center line of the tray. This allows the tray to be easily lifted without tipping. The tray is approximately twenty-one inches long and seven inches wide. This allows two trays to fit side by side in a mechanic's tool drawer.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A tool storage device for retaining sockets used in ratchet wrenches, the improvement comprising:

a tray having a top and supporting means to dispose the top in a position spaced above a supporting surface;

opening means located in the top and providing a plurality of seat means with a base located below said top and having means connecting with the top and forming a continuation thereof and also providing spaced slits;

resilient retaining fingers having upstanding sides and having leg means extending outwardly and spaced apart a distance greater than the distance between the spaced slits whereby when the leg means are located in the slits a retaining biasing force is provided to hold the fingers securely in position.

2. The tray of claim 1 wherein:

said supporting means of said tray includes a metal top having a plurality of openings, and downwardly extending ends and sides;

handle means extending from the tray and having ledge means providing a step portion which may be easily grasped.

3. The tool storage device of claim 2 wherein said handle means include:

means formed integrally from the tray and extending upwardly and diagonally therefrom about the centerline of the tray to thereby allow the tray to be grasped at each end and easily lifted;

said ledge means having a portion formed from a section of the ends of the tray.

4. The tool storage device of claim 1 wherein said opening means includes:

a rectangular cutout formed by displacing a portion of the tray;

said base being formed by the portion of the tray displaced to provide the rectangular cutout and said base including first sides cut clean from the tray and also having second sides connected with the tray;

said first sides cut clean of the tray provides side margins below the tray to form the slits.

5. The tool storage device of claim 4 wherein said resilient retaining fingers include;

support tab lying in a plane with the leg means and extending in an opposite direction to contact the base and hold the retaining fingers in position to prevent the fingers from slipping through the slits.

6. The tool storage device of claim 1 wherein said opening means in the top of the tray includes:

a large rectangular cutout with smaller cutouts spaced across the larger cutout;

said base having an outline corresponding with the outline of the larger rectangular cutout and smaller cutouts;

said base having extensions adapted to contact the leg means of an associated retaining finger to support the finger in position.

7. The tool storage device of claim 1 wherein said opening means include:

four rows of openings spaced on the tray in such a fashion that when sockets are loaded on the retaining fingers, the tray is balanced.

* * * * *